United States Patent [19]

Nakamura

[11] Patent Number: 4,461,475

[45] Date of Patent: Jul. 24, 1984

[54] GAME MACHINE HAVING POP-UP TARGET

[75] Inventor: Masaya Nakamura, Tokyo, Japan

[73] Assignee: Namco Limited, Tokyo, Japan

[21] Appl. No.: 337,214

[22] Filed: Jan. 5, 1982

[30] Foreign Application Priority Data

Apr. 14, 1981 [JP] Japan ..... 56-55041

[51] Int. Cl.[3] ..... A63F 9/00

[52] U.S. Cl. ..... 273/1 GC; 273/85 G; 273/67 R; 273/369; 273/374; 273/386

[58] Field of Search ..... 273/1 GE, 1 GC, 1 M, 273/1 E, 1 GD, 127 R, 127 B, 127 D, 374–376, 118 A, 119 A, 120 A, 121 A; 340/815.24, 815.29

[56] References Cited

U.S. PATENT DOCUMENTS 3,422,426 1/1969 Bailey et al. ..... 340/815.24
3,573,811 4/1971 Knecht ..... 340/815.24
3,636,556 1/1972 Pihl ..... 340/373
3,828,288 8/1974 Boyd ..... 335/234
4,249,736 2/1981 Rosenthal ..... 273/127 R

*Primary Examiner*—Richard C. Pinkham
*Assistant Examiner*—Mary Ann Stoll
*Attorney, Agent, or Firm*—Jordan and Hamburg

[57] ABSTRACT

A game machine has a plurality of targets which unpredictably come out and disappear from their corresponding holes at the surface of a table on a game stand. A player can only strike targets which are positioned above the surface thereof. A main shaft is provided with the target on its upper end and is supported by bearings in such a manner that it can rotate and move up and down. A plunger disposed at the periphery of the main shaft is magnetically attracted by an electromagnetic solenoid. When raised, the main shaft always faces a predetermined direction due to an action of permanent magnets. Hitting of the target can be detected by monitoring abrupt large fluctuations in current flowing through the solenoid during a period of time that the target is caused to appear above the table.

7 Claims, 7 Drawing Figures

GAME MACHINE HAVING POP-UP TARGET

BACKGROUND OF THE INVENTION

1. Field of the Invention

The present invention relates to a game machine provided with a plurality of targets which unpredictably come out and disappear from its corresponding holes at the surface of a table on a game stand, and wherein a player can strike some of targets only which are positioned above the surface thereof, and more particularly to an up-and-down motion mechanism and a hitting detection mechanism for the target.

2. Description of the Prior Art

A game machine of this kind has been known under a name of the so-called "mole striking game machine" in which the target is patterned after the model of a character of a mole, but an up-and-down motion for the target was performed by using a lever 8 rocked by a crank mechanism as shown in FIG. 1, pushing up a supporting rod 6 for a target 4 by means of the lever 8, and causing a target head portion 5 to thrust out of an associated hole 3 provided at the surface of a table 2 on a game stand 1. However, in the case of such conventional game machine as stated above, the production cost thereof was high because there were a lot of mechanical components, and many troubles had been reported. The machine itself was not very durable because mechanical portions such as bearing 7 and lever 8 were often subjected to unreasonable forces applied when the target was struck or knocked. In addition, the detection for hitting was performed by a combination of a microswitch MS disposed within the target head portion 5 and an operating lever 9 projected into the target head portion 5, so that the hitting detection mechanism was often damaged by unnatural forces induced by hitting or other various external shocks.

SUMMARY OF THE INVENTION

It is therefore a primary object of the subject invention to provide a target-hitting type game machine which is durable and free from any trouble.

Another object of this invention is to provide an up-and-down motion mechanism in which a target always looks in the same direction when thrust out of the surface of a table.

Still a further object of this invention is to provide a hitting detection mechanism wherein hitting of the target is electrically detected without using mechanical parts.

In accordance with one feature of the present invention, a game machine comprising a game stand provided with a table having at least one hole thereon, a main shaft supported movably up and down by bearings and having a target head portion which is mounted on the upper part thereof and can pass through the associated hole to appear above the surface of the table, a plunger made of magnetic material and partially disposed at the periphery of the main shaft in its axial direction, at least one solenoid means located slightly above the plunger or at a place where the upper region of the plunger partly overlaps the solenoid means and the inner dimension of which is so determined that the plunger on the main shaft can freely pass therethrough, and a control circuit for controlling the energization and deenergization of the solenoid means and causing the target head portion to come out and disappear from the surface of the table can be provided. In this construction, the target is held at its protruded position by magnetic attraction where the target head portion by magnetic attraction projects above the surface of the table, so that the target can freely escape downward when it is struck and therefore a durable and low maintenance up-and-down motion mechanism for the target can be obtained. The same effect can also be obtained by causing the main shaft to have a comparatively large block member fixedly mounted on the lower portion thereof and of a rectangular shape if viewed from the bottom thereof, rendering one side surface of the block member to slidably abut against a guide wall running in the longitudinal direction and secured to a machine frame and thereby making the main shaft not to rotate. Increase in the amount of stroke for the target may be preferably accomplished by forming the aforesaid solenoid means with two solenoids stacked one above another, that is, an upper solenoid and a lower solenoid, energizing both solenoids simultaneously when the target head portion is to be raised for the first step, and then placing only the lower solenoid under its deenergized condition for the second step.

According to another feature of the present invention, an improved game machine can be provided which comprises a main shaft supported by bearings such that it can rotate and move up and down, a first permanent magnet disposed at the longitudinal side of the main shaft and at a place where the up-and-down motion of the main shaft will not be hindered, a second stationary permanent magnet disposed so that it meets the first permanent magnet in the face when the main shaft, that is, the target head portion attached thereto is raised above the surface of the table, and as the result, the target head portion can be maintained above the surface of the table by an attractive force between the first and the second permanent magnets with the target head portion facing towards a predetermined direction. In this arrangement, the main shaft is restrained by only an attractive force of the permanent magnets, and it can rotate freely and escape downward from the restrained position when the target is hit by a player, so that no mechanical damage will occur on any moving parts such as the main shaft and others. It is preferable to provide a plurality of permanent magnet pieces on the periphery of the main shaft as the first or the second permanent magnet.

According to still another feature of the present invention, the control circuit includes a hitting detection circuit for monitoring abrupt large fluctuations in current produced in the upper solenoid during a period of time that the upper solenoid is supplied with a current for holding the target head portion above the surface of the table, and turning off the switching circuit for the upper solenoid when a predetermined amount of change in current is detected. In this construction, the presence or absence of striking can be electrically judged without using any mechanical parts and there is no element which is subject to any damage due to hitting, so that the durability of the machine can be greatly enhanced. Preferably, the hitting detection circuit includes a safety circuit for making the output of the hitting detection circuit null and void until a predetermined time of delay from the energization of the solenoid elapses, in order to increase the reliability for detection.

BRIEF DESCRIPTION OF THE DRAWINGS

The novel features of the subject invention as well as the invention itself, and the objects and advantages thereof will be better understood from the following description taken in conjunction with the accompanying drawings in which.

DESCRIPTION OF THE PREFERRED EMBODIMENTS

The present invention will hereinafter be explained with reference to the preferred embodiments illustrated in FIGS. 2–5.

Figure 1:
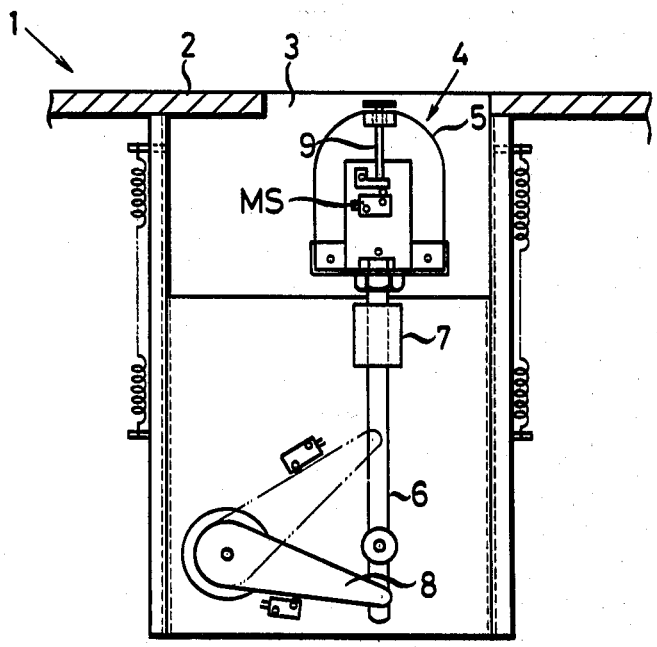
FIG. 1 shows a schematic diagram of an up-and-down motion mechanism for the target in accordance with a typical, prior art game machine.
Figure 2:
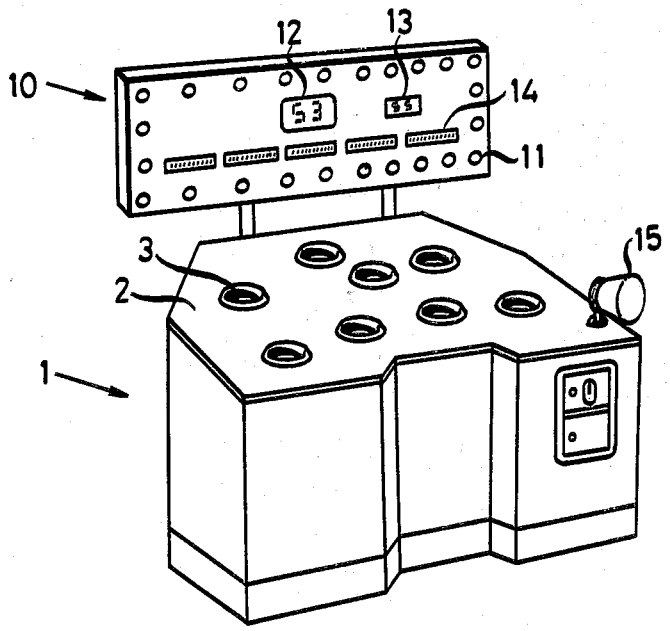
FIG. 2 shows a schematic perspective view of a game machine in accordance with the present invention.

In FIG. 2 of the drawings, there is illustrated an inclined table 2 of a game stand 1 having a plurality of holes 3, through each of which a target 4 (FIG. 3), patterned after the model of a particular character, can pass. Disposed on a rear panel 10 are a plurality of time indication lamps 11, a score display 12 for the game being played, a score display 13 for the highest score ever acquired, and a plurality of real power displays for players. A hammer 15 made of wood or comparatively soft material is received in a small hole at the right-hand corner of the table 2.

Figure 3:
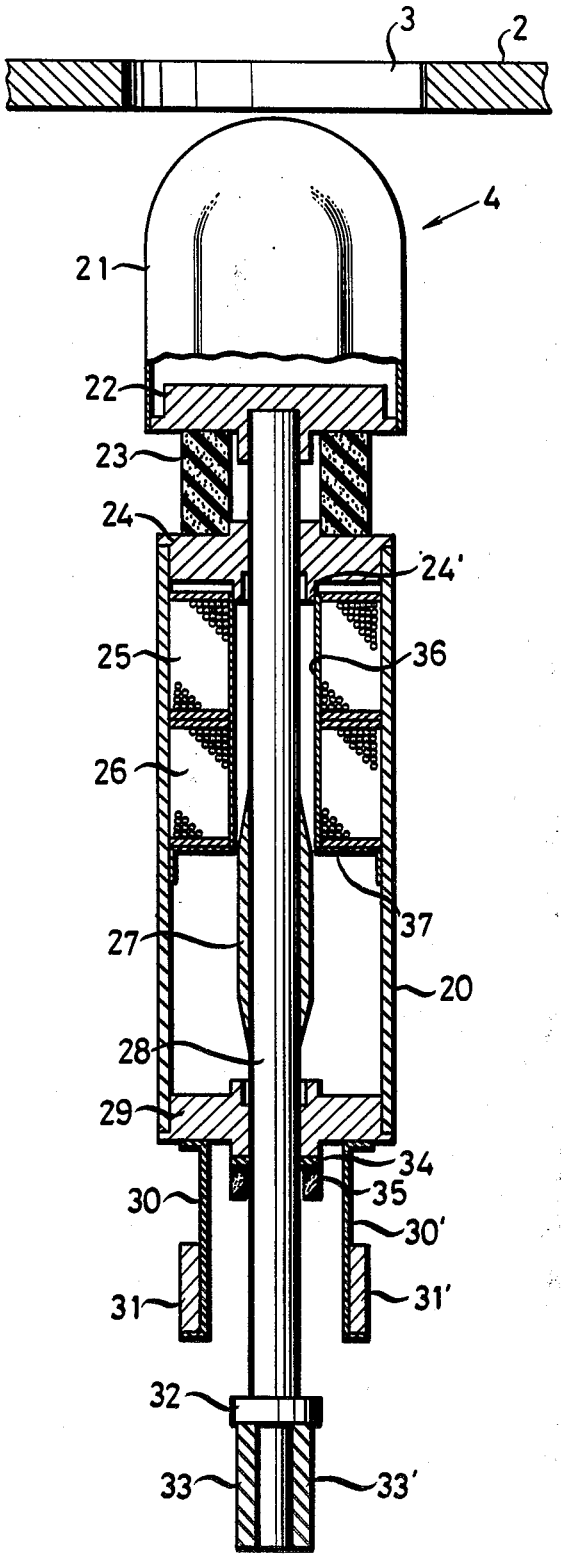
FIG. 3 shows a longitudinal sectional view illustrating one of the up-and-down motion mechanisms used in FIG. 2.

Referring now primarily to FIG. 3, a head portion 21 of the target 4 is made of a glass fiber reinforced plastic or polycarbonate and screwed to the upper end of a main shaft 28 of acetal resin through a disc 22 of acetal resin. The main shaft 28 of the target 4 is fluctuatingly and rotatably supported by means of acetal bearings 24 and 29 fitted into the upper and the lower ends of a cylindrical casing 20 and screwed thereto, respectively. The main shaft 28, bearings 24 and 29 can be made of magnetic material. The casing 20 is fixed to the game stand 1, and a cylindrical cushion 23 of soft material such as neosponge is disposed between the upper bearing 24 and the disc 22. Thus, the target head 21 is ordinarily seated on the cushion 23. The main shaft 28 passes through the casing 20 and has a stopper 32 of acetal resin in proximity of the lower end of the main shaft 28 to prevent it from flipping away in the upward direction. Corresponding to this stopper 32, a cylindrical cushion 35 of such soft material as neosponge is mounted on the lower surface of the lower bearing 29 via a washer 34 of acetal resin.

As clearly seen in FIG. 3, electromagnetic solenoids 25 and 26 are mounted between the upper bearing 24 and the lower bearing 29 of the casing 20 in such that they are axially adjacent the upper bearing 24 in two stages and surround the main shaft 28. The positioning of these solenoids can be made by a partition plate 37 disposed midway within the cylindrical casing 20, a common brass tube 36 disposed along the insides of both solenoids, and a depending boss 24' which is part of the upper bearing 24 and used to hold the tube 36. In addition, as also clearly seen from FIG. 3, between the upper bearing 24 and the lower bearing 29, a plunger 27 of an iron pipe is secured to the main shaft 28 by means of screws so that the shaft is partially covered with the plunger in its axial direction at the peripheral surface thereof. The upper end of the iron pipe 27 is located within the hollow coil region of the lower solenoid 26, the lower end of the pipe 27 is located above the lower bearing 29 the nearly same distance as the thickness of the cushion 23 and both ends terminate at the peripheral surface of the main shaft 28 with a gentle taper.

With only the lower solenoid 26 or both the solenoids 25 and 26 energized, the plunger 27 is attracted upward, and the main shaft 28, hence, the head portion 21 and the stopper 32 affixed thereto are moved upward. Subsequently, when only the upper solenoid 25 is energized, the plunger 27 is further moved upward and then stops when the stopper 32 abuts the bottom side of the lower bearing 29 via the cushion 35. When the solenoid is deenergized, the target 4 falls with its dead weight and rests on the cushion 23. If the target 4 is struck downward at the projected position, the head portion 21 and the main shaft 28 are forcibly lowered against an electromagnetic attraction.

Beneficial points of this up-and-down motion mechanism are that it is very simple in its construction and cheap in production costs, and that there exists no mechanical parts which are to be associated with a sudden falling action of the main shaft 28 and thereby deformed with unnatural forces. In short, when the target head portion is struck by means of the hammer 15 made of sponge, the main shaft 28 may be moved only with an energy sufficient to overcome the electromagnetic force, produced by the solenoid 25 and holding the shaft at its projected position. Thus, a shock occuring at the time of hitting the head portion 21 and transmitted to the shaft is small and the final shock, at a time when the bottom side of the head 21 comes in touch with the case 20, may be absorbed through the cushion 23. Therefore, the up-and-down mechanism is durable and its life expectancy is very long. If the plunger 27 is disposed near the upper solenoid 25, the lower solenoid 26 can be omitted so that the plunger 27 will be operated by only one solenoid 25. In this case, the stroke of the plunger is shorter, so that the position of the stopper 32 must be modified in response thereto.

Since the target head portion 21 is in general patterned after the model of a specific character, the head portion 21 itself has distinctive front and rear surfaces. For example, if the target is patterned in imitation of a mole, the front and the rear surfaces correspond to the face and the back of the head, respectively, and the head portion must be so projected that the face of the mole always faces this side of FIG. 2 during the game.

In this regard, if any kind of guide is employed for guiding the main shaft 28 through a corresponding slot, it is evident that the guide portion of the slot is liable to be damaged by unreasonable forces caused by violent handling of a player To avoid these inconveniences, in the embodiment illustrated in FIGS. 3 and 4, there are provided bar-like permanent magnets 31 and 31' below the lower bearing 29 and along the main shaft 28 by means of aluminum-made supporting plates 30 and 30' which are diametrically arranged with respect to and apart from the main shaft 28 and secured to the bottom of the bearing 29 as shown in FIG. 3. The magnets 31 and 31' may be screwed or adhered to the outsides of the plates 30 and 30', respectively. Similarly, bar-like permanent magnets 33 and 33' are fixed to the main shaft 28 on the flat portions which are formed at the longitudinal sides thereof underneath the stopper 32 in such that they are diametrically and oppositely arranged with respect to the main shaft 28. In this example, although two magnet pieces are used as 33 and 33', a single equivalent magnet may be employed. The stationary magnets 31 and 31' extend longitudinally from the lower end of the supporting plates 30 and 30', respectively, and the other magnets 33 and 33' extend along the main shaft 28 over a comparatively large distance, so that the magnet 33, 33' approaches and then overlies the magnet 31, 31' during the course that the main shaft 28 is moved to its uppermost position. In this case, the stationary magnets 31 and 31' are arranged so that different polarities appear on the inner sides facing to each other, whereas the movable magnets 33 and 33' are arranged in such a manner that the other polarities with respect to that of the stationary magnets appear on the outer sides thereof so as to place the target face in its angularly correct direction. If desired, either of the magnets 31, 31' and either of the magnets 33, 33' can be omitted.

As the result of the mounting of the magnets 31, 31' and 33, 33' in such polarities as stated above, the main shaft 28 turns round under the influence of a repulsive force or attractive force between these magnets without fail when raised, and then becomes stationary at an angular position where the magnets 31 and 33 as well as the magnets 31' and 33' attract each other. At this angular position, the target head portion 21 assumes its correct position toward the player. When the target head portion 21 is pushed by means of the hammer and the like so that a rotational moment exceeding the stationary attractive force of the magnets is applied to the target head portion 21, the main shaft 28 will absorb such impact while rotating freely in the direction that it is pushed, and there is no mechanical coupling which blocks the rotation of the shaft 28, so that a longer service life can be assured.

Alternatively, the correct positioning of the character may be accomplished by fixing a comparatively large block member made of acetal resin and of rectangular shape if viewed from the bottom side thereof to the lower part of the main shaft 28, and slidably disposing one side of the block member along a guide wall running in the longitudinal direction and secured to the frame of the game machine. By doing so, the turning effort of the main shaft applied externally is completely blocked by the abutting relationship between the guide wall and the sliding side of the comparatively large block member. One of advantages in this construction is that the production cost is less as compared with the example of FIG. 3.

Under the steady state the target head portion 21 is kept at its projected position by the attractive force of the upper solenoid 25, the current flowing through the solenoid 25 remains substantially constant unless the main shaft or plunger 27 is moved. However, in the transition state that the plunger 27 is attracted by the electromagnetic force or at the instant the plunger 27 is moved by any external force, the magnetic flux is disordered so that the current flowing through the solenoid is varied in response thereto. Accordingly, the presence or absence of external forces to be applied on the target head portion 21 is detectable by neglecting the fluctuations of solenoid current which may produced in the transition state or immediately after the commencement of the attraction of the plunger and by monitoring the solenoid current in the steady state or after the plunger has been stabilized at the raised position. The method of detecting the strike-down motion of the target will hereinafter be explained in connection with the control circuit illustrated in FIG. 5.

Figures 4, 5:
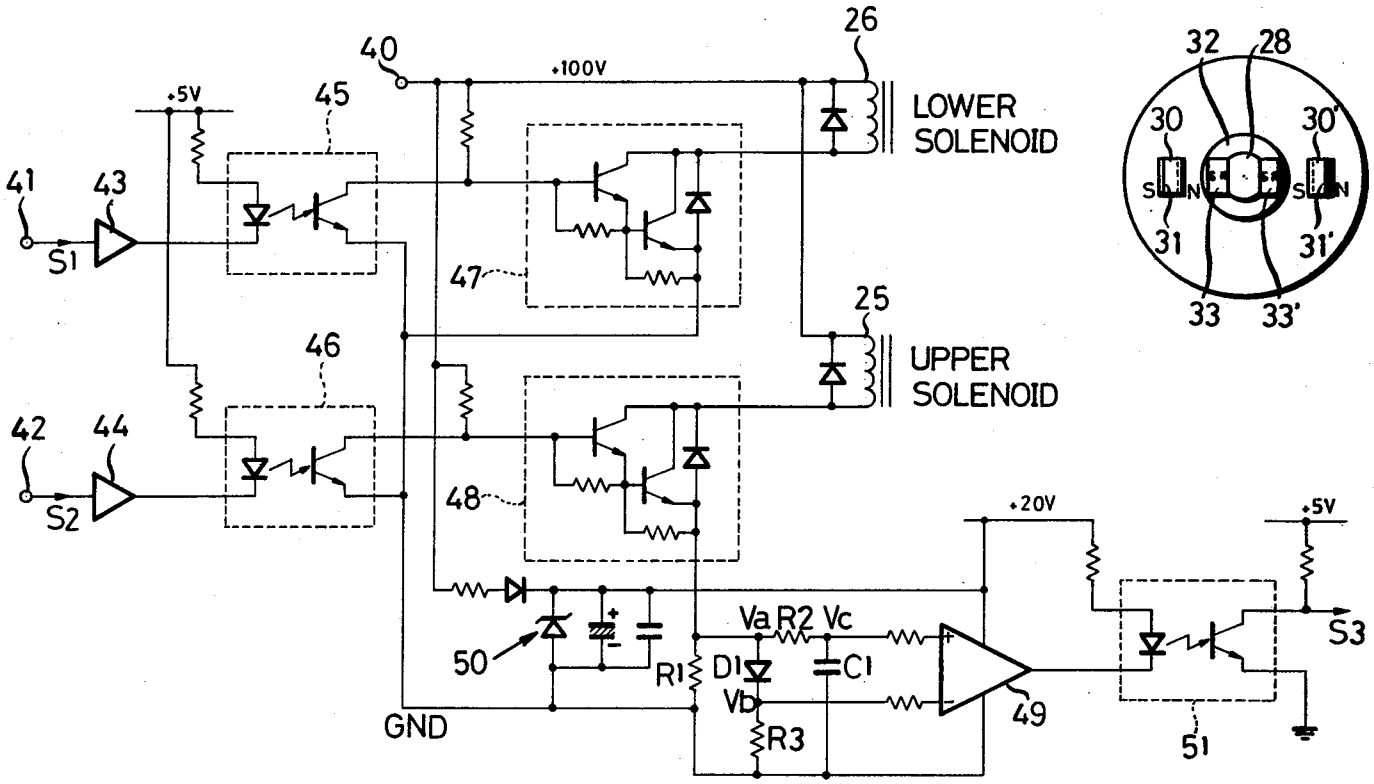
FIG. 4 shows an end plan view looked from the bottom side of FIG. 3.
FIG. 5 shows an electrical control circuit useful for explaining the driving of the up-and-down motion mechanism and the detection of strike-down operation for the target.

Referring primarily to FIG. 5, one end of the lower solenoid 26 is connected to a terminal 40 of +100 V from a single phase full-wave rectified power supply (without a smoothing circuit), and the other end of which is grounded through a switching circuit 47 consisting of a darlington-transistor. Similarly, one end of the upper solenoid 25 is connected to the power supply terminal 40 and the other end is grounded through a switching circuit 48 consisting of another darlington-transistor. The bases of transistors in the previous stages of the switching circuits 47 and 48 are connected to phototransistors in photocouplers 45 and 46, respectively. The anode sides of light emitting diodes in the photocouplers 45 and 46 are connected to a d-c line of +5 V, and the cathode sides thereof are connected to input terminals 41 and 42 through open collector buffer 43 and 44, respectively. Therefore, the lower solenoid 26 and the upper solenoid 25 are energized through the switching circuits 47 and 48 at a time when positive signals are applied to the input terminals 41 and/or 42.

The reason why individual switching circuit is provided to each solenoid is, as stated above, to enable the plunger attracted by the lower solenoid 26 to be further moved upward by the attractive force given by the upper solenoid only. Thus, only the upper solenoid 25 is placed under the energized condition when it is located at the raised position, and the hitting or target strike-down is detected by monitoring abrupt large fluctuations in current induced in the upper solenoid 25.

For this purpose, there is provided a resistor R1 of low resistance in series with the current path for the upper solenoid 25. In this example, a resistor of 2Ω is inserted between the switching circuit 48 and the earth as R1. Connected across the resistor R1 is a R-C integration circuit comprising a resistor R2 and a condenser C1, and the voltage Vc at the condenser output terminal in the integration circuit is inputted into a non-inverting input terminal of a comparator 49. In addition, a series circuit consisting of a detection diode D1 and a resistor R3 is connected across the resistor R1, and the voltage Vb across the resistor R3 is applied to an inverted input terminal of the comparator 49. The output terminal of the comparator 49 is connected to a light emitting diode of a photocoupler 51, and a hitting signal or a strike-down detection signal S3 is taken out of a light receiving element of the photocoupler 51. In addition, a Zener diode 50 is used as a circuit to produce a d-c voltage of 20 V for the comparator 49.

The current flowing through the upper solenoid 25 also flows in the resistor R1, and the terminal voltage Va of R1 is substantially in proportion to the current flowing through the upper solenoid. To reduce a current flowing through the resistor R3 via the diode D1, it is preferable to make the value of the resistor R3 larger than that of R1, for example, in the order of 1 kΩ. The terminal voltage Vb of R3 is lower than Va by approximately 0.6 V of a forward voltage drop in the diode D1. The voltage Va is integrated by the resistor R2 and the condenser C1 to obtain Vc. The establishment of Vc is delayed by the time determined by a time constant of R2·C1 with respect to Va.

Thus, the voltage Vb would always be lower than Vc so long as Va is substantially steady. On the contrary, when Va is varied or if the flux within the solenoid is disturbed due to sudden shock to the plunger, Vb becomes higher than Vc. As the result of comparison of Vb with Vc at the voltage comparator 49, the hitting or strike-down operation for target head portion 21 by means of the hammer can be detected.

Figure 6:
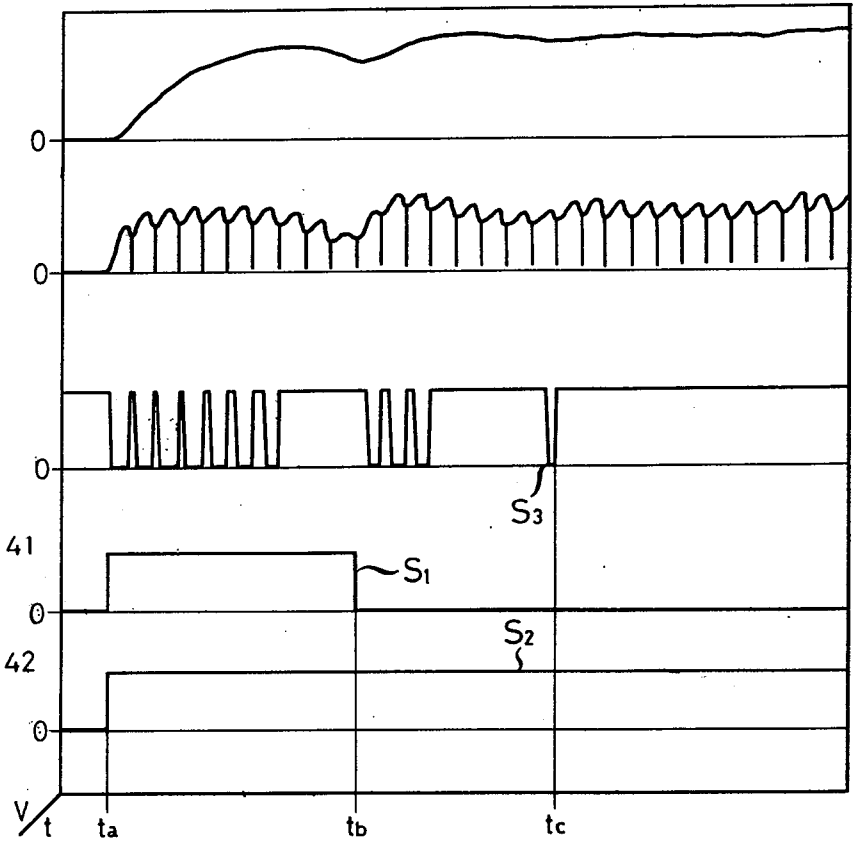
FIG. 6 shows a diagrammatical view for time versus waveforms in main points of the control circuit, obtained during a time interval from the starting of a plunger attached to the target until it comes to a standstill at its protruded position.

Referring now primarily to FIG. 6, the transition from the beginning of plunger attraction till it becomes steady will hereinafter be explained.

An assumption is first made that the target 4 is located at the lowermost position as indicated in FIG. 3. At time ta, actuating signals S1 and S2, corresponding to (d) and (e) in FIG. 6, for both the solenoids 26 and 25 are applied to the input terminals 41 and 42, respectively. The light emitting diodes in the photocouplers 45 and 46 are extinguished to turn off the phototransistors therein. The switching circuits 47 and 48 are thereby turned on to energize both the lower solenoid 26 and the upper solenoid 25. Thus, the plunger 27 is pulled up by a distance corresponding to one step. At this junction, since the voltage drop Va corresponding to (b) in FIG. 6 is induced in the resistor R1 by the current flowing through the upper solenoid 25, the output voltage Vc (corresponding to (a) in FIG. 6) of the R-C integration circuit exponentially rises from the time ta. Subsequently, at time tb after 0.1 second, for example, the actuating signal S1 for the lower solenoid 26 is terminated and only the upper solenoid 25 is placed under its energized condition, so that the plunger 27 is attracted upward until the main shaft is brought to a standstill by the stopper. At time tc, it is assumed that the target head portion 5 is kept at the uppermost position above the surface of the table 2. During this course, the angular positioning of the target head portion 5 will be automatically made by the action of the permanent magnets 31, 31', 33 and 33'.

The output of the comparator 49 during the time interval ta-tc corresponding to approximately 0.2 sec. is not settled as indicated in FIG. 6-(c) because the target 4, hence the plunger 27 is not still at a standstill. When the plunger 27 is settled down at time tc, the output of the comparator 49 remains at such a stable condition as it never goes to a zero-volt condition (or a level under which the signal S3 is generated). In FIG. 6, although there is not depicted a waveform for the inverted input Vb of the comparator 49, it is almost the same as that indicated in FIG. 6-(b) excepting that the voltage level thereof is lower than the indicated one by the magnitude corresponding to the forward voltage drop of the diode D1. To permit detection for strike-down motion, the signal S3 or 0 V appearing on the comparator 49 during the period that the plunger 27 is placed under its stationary state or for a duration of 0.25 sec. from ta is neglected as false signals due to transient phenomena for only its initial period, by connecting the line carrying the output signal S3 to the ground through a switch incorporated in a safety circuit.

Next, in connection with FIG. 7, the circuit operation for the strike-down detection for the target 4 which has been kept at the uppermost position will hereinafter be explained in detail.

Figure 7:
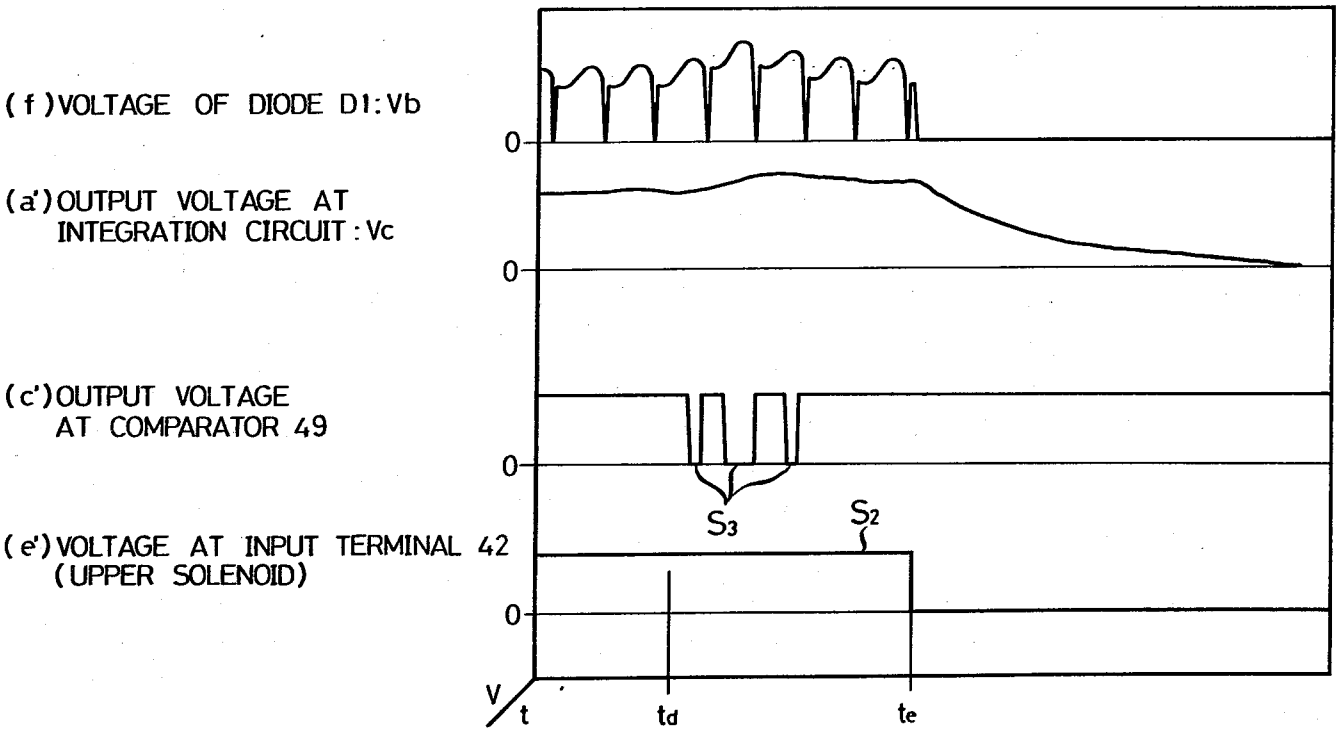
FIG. 7 shows a diagrammatical view similar to FIG. 6, obtained when the target is struck after having been stationally placed in the protruded position.

The time td in FIG. 7 shows the instant that the player strikes the target head portion 5. Since the upper solenoid 25 is still maintained under its energized condition, the magnetic field in the upper solenoid 25 is disturbed because the plunger 27 is forcibly pushed downward together with the main shaft 28 and vibrated violently, and a certain amount of voltage is induced therein. As the result, the terminal voltage Va across the resistor R1 and the diode-detected output voltage Vb violently vary as illustrated in FIG. 7-(f). However, it frequently happens that the terminal voltage Vb of the diode D1 exceeds the voltage Vc in the integrated circuit since the Vc is the integrated one for the inputs, so that it is also frequently happens that the output voltage of the comparator 49 results in zero volts in response thereto as shown in FIG. 7-(c'). In short, as the result, the strike-down detection signal S3 of positive level can be observed.

In more detail, if the voltage Va is almost in the steady state, the voltage Vb at the inverted input terminal of the comparator 49 always remains lower than the voltage Vc at the non-inverting input terminal thereof. On the contrary, when the voltage Va varies abruptly, that is, the magnetic flux in the upper solenoid 25 is disturbed due to quick motion of the plunger 27, the voltage Vb at the inverted input terminal becomes higher than the voltage Vc at the non-inverting input terminal. The detection for strike-down motion of the target can be checked by comparing Vb with Vc.

When the strike-down detection signal S3 is provided, the signal S2 is cut off at time te as the result of judgement that the strike-down action has been performed by the player, and the target head portion 21 is thereby moved downward.

While the present invention has been described in connection with only one unit illustrated in FIG. 3, a complete game machine is generally constructed by providing for a plurality of units, actuating these units randomly with respect to time by use of a number of signals S1 and S2, and rendering strike-down signals to be read out as scores. Players can compete with each other for the number of times in hitting acquired by striking the head of the character randomly emerging from each hole 3.

In addition, although the pulsating direct current is used as a power supply for operating the solenoids, it is apparent that a smoothed direct current may be used as well. Instead of the example illustrated in FIG. 5 wherein the photocouplers 45 and 46 are used to apply the actuating signals to the switching circuits 47 and 48 for both the upper and the lower solenoids, the actuating signals may be applied directly to the switching circuits 47 and 48 depending on what level of actuating signal is utilized. Similarly, the photocoupler 51 may be omitted.

What is claimed is:

1. A game machine comprising:

a game stand having a table through which at least one hole extends;

a main shaft supported by bearings to be movable up and down and having a target heat portion at the upper end thereof so that the target head portion can pass through an associated one of said holes in the table;

a plunger of magnetic material and disposed partially on the periphery of the main shaft and extending in its axial direction;

solenoid means having at least one solenoid mounted to upwardly attract said plunger, the inner dimension of which enables the plunger on the main shaft to freely pass therethrough; and a control circuit for controlling the energization and deenergization of the solenoid means, whereby the target head portion is caused to appear on the surface of the table and disappear therefrom, said control circuit having a switching circuit in series with a current path for the solenoid and a hitting detection circuit comprising (a) a resistor in series with the current path for the solenoid, (b) a first circuit connected to said resistor and arranged to provide an output voltage which is lower than the voltaga across the resistor by a predetermined level and is varied as the voltage across the resistor, (c) a second circuit connected to said resistor and arranged to provide an output voltage which corresponds to the voltage across the resistor and is delayed with respect to an instantaneous level transition of the voltage across the resistor, and (d) a comparision circuit for comparing the output voltage of the first circuit with an output voltage of the second circuit and for producing an output at a time when the output voltage of the first circuit exceeds the output voltage of the second circuit whenever the comparison circuit outputs a signal of a hit.

2. A game machine according to claim 1 wherein said main shaft is supported by the bearings in such a manner that it can rotate and move up and down, further including a first permanent magnet disposed at the longitudinal side of the main shaft and at a place where the up-and-down motion of the main shaft will not be disturbed, and further including a second stationary permanent magnet disposed so that it is aligned with the first permanent magnet when the main shaft is raised at a position where the target head portion projects above the surface of said table, whereby the target head portion can appear above the surface of said table in an angularly predetermined direction due to an attractive force between the first and second permanent magnets.

3. A game machine according to claim 1 wherein said solenoid means comprises an upper solenoid and a lower solenoid stacked in two stages, and said control circuit includes a first switching circuit for the upper solenoid, a second switching circuit for the lower solenoid, and change-over means for turning on both said switching circuits simultaneously so that said target head portion projects above the surface of said table and subsequently turning off said second switching circuit for the lower solenoid.

4. A game machine according to claim 3 wherein said hitting detection circuit comprises:

a first resistor of low resistance inserted in series with a current path for the upper solenoid;

an R-C integration circuit connected across said first resistor;

a series circuit including a diode and a second resistor, and connected across said first resistor; and a comparison circuit which compares a voltage across the second resistor with an output voltage of the integration circuit and produces an output at a time when the voltage across the second resistor exceeds the output voltage of the integration circuit.

5. A game machine according to claim 4 wherein said hitting detection circuit further includes a safety circuit which invalidates the output of said comparison circuit until a predetermined time of delay from the energization of the upper solenoid elapses.

6. A game machine according to claim 1 wherein said hitting detection circuit comprises:

a first resistor of low resistance inserted in series with the current path for the solenoid means;

an R-C integration circuit connected across said first resistor;

a series circuit including a diode and a second resistor, and connected across said first resistor; and a comparison circuit which compares a voltage across the second resistor with an output voltage of the integration circuit and produces an output at a time when the voltage across the second resistor exceeds the output voltage of the integration circuit.

7. A game machine according to claim 6 wherein said hitting detection circuit further includes a safety circuit which invalidates the output of said comparison circuit until a predetermined time of delay from the energization of said solenoid elapses.

* * * * *